US006731215B2

(12) United States Patent
Harms et al.

(10) Patent No.: US 6,731,215 B2
(45) Date of Patent: May 4, 2004

(54) MOISTURE MONITORING SYSTEM

(76) Inventors: Frederick H. Harms, 8904 W. 102nd, Apt. 1, Overland Park, KS (US) 66212; Charles McKenzie, 52 Victoria Street, Johannesburg (ZA), 2130

( * ) Notice: Subject to any disclaimer, the term of this patent is extended or adjusted under 35 U.S.C. 154(b) by 0 days.

(21) Appl. No.: 09/682,063

(22) Filed: Jul. 16, 2001

(65) Prior Publication Data

US 2003/0011482 A1 Jan. 16, 2003

Related U.S. Application Data

(60) Provisional application No. 60/250,225, filed on Nov. 30, 2000.

(51) Int. Cl.[7] ..... G08B 21/00; G08B 23/00

(52) U.S. Cl. ..... 340/605; 340/602; 340/603; 340/604; 340/573.5; 200/61.04; 200/61.05

(58) Field of Search ..... 340/602, 603, 340/604, 605, 539, 573.5; 200/61.04, 61.05, DIG. 40

(56) References Cited

U.S. PATENT DOCUMENTS

| | | | | | |
|---|---|---|---|---|---|
| 2,907,841 | A | * | 10/1959 | Campbell | 200/61.05 |
| 3,944,916 | A | * | 3/1976 | Tillander | 324/694 |
| 4,212,295 | A | * | 7/1980 | Snyder | 128/886 |
| 4,502,044 | A | * | 2/1985 | Farris et al. | 340/604 |
| 5,086,291 | A | * | 2/1992 | Schwab, Jr. | 340/604 |
| 5,192,932 | A | * | 3/1993 | Schwab, Jr. | 340/604 |
| 5,655,561 | A | * | 8/1997 | Wendel et al. | 137/79 |
| 5,790,036 | A | * | 8/1998 | Fisher et al. | 340/605 |
| 5,992,218 | A | * | 11/1999 | Tryba et al. | 73/40.5 R |
| 6,025,788 | A | * | 2/2000 | Diduck | 340/870.16 |
| 6,369,714 | B2 | * | 4/2002 | Walter | 340/605 |

OTHER PUBLICATIONS

Woven Fabric description from website www.seiren.com/english/fabric/pl/main_wf.html—Attachment I, May 18, 2001, USA.

Non–Woven Fabric description from website www.seiren.com/english/fabric/p2/main_nw.htm—Attachment II, May 18, 2001, USA.

Viledon description from website www.viledon–filter.co.uk/p/products.htm, Aug. 28, 2001, USA.

Watercop wepage "Introducing Water Cop Emergency Shut–Off System," www.watercop.com, Jul. 18, 2001, USA.

* cited by examiner

*Primary Examiner*—Jeffrey Hofsass
*Assistant Examiner*—Lam Pham
(74) *Attorney, Agent, or Firm*—Chase Law Firm, L.C.

(57) ABSTRACT

A leakage response system for an appliance includes a leakage sensor which is operative to change an electrical parameter upon contact by a conductive liquid, a controller circuit electrically coupled with the strip for generating an activation signal in response to contact of the strip by a conductive liquid and a response device coupled with the controller circuit and activated by the signal. The sensor includes a mat which is constructed of top and bottom outer layers of electrically conductive fabric separated by a central nonconductive fabric layer; and a pair of fusing layers fusing the top and bottom layers to the central nonconductive layer. The sensor may also include a pair of conductive pins for installation into a surface for detecting moisture hidden within the surface. The response device may include an audible alarm and/or a valve for shutting off the water flow in the appliance water supply line. The response device may also include a radio link for activating a remote alarm and shut off valve. An alternate sensor mat includes a pair of apertured foil conductive layers separated by a nonconductive layer, and a pair of fusing layers fusing the foil conductive layers to top and bottom nonconductive absorbent layers.

14 Claims, 4 Drawing Sheets

MOISTURE MONITORING SYSTEM

CROSS REFERENCE TO RELATED APPLICATIONS

This application claims priority under 35 U.S.C. §119(e) and 37 C.F.R. 1.78 (a) based upon copending U.S. Provisional Patent Application No. 60/250,225, entitled Moisture Sensor, which was filed on Nov. 30, 2000.

BACKGROUND OF INVENTION

1. Field of the Invention

The present invention is concerned with a system for monitoring and responding to moisture leakage.

2. Description of the Related Art

Many of the appliances and fixtures in modern homes and commercial buildings are equipped with water supply lines. Because these lines occasionally develop leaks, water damage to floor coverings sub-floors and ceilings are becoming increasingly common. In particular, refrigerators, icemakers, dishwashers, washing machines, as well as sinks and toilets are subject to such leakage. Since water supply lines are usually placed behind and underneath appliances and fixtures for cosmetic purposes, any leakage from the lines or their couplings adjacent the water inlet, appliance valve or mechanism may not be discovered until an appliance is moved or the leak becomes sufficiently large to be visible from in front of the appliance or fixture. By the time such leakage becomes known, the water may well have caused damage to the floor covering, sub-floor, or a ceiling below.

Certain floor coverings such as, for example, wood surfaces are particularly vulnerable to water damage. Even a small leak under a refrigerator, such as a continuous intermittent drip, can cause damage to a wood flooring material or covering. Repair of damage to such surfaces typically involves replacing the damaged area followed by sanding and refinishing of the entire floor surface so that the finish on the new wood may be blended to conform to the finish on the remainder of the floor. Thus, leakage of even a relatively small quantity of moisture which goes undiscovered for a period of time can cause damage to a susceptible surface which eventually necessitates costly repairs. Certain appliances, such as refrigerator ice-making units, are particularly likely to leak and cause such damage at some time during the course of their usage because refrigerators are often moved periodically for cleaning of the floor surface beneath them.

Other types of floor coverings are also susceptible to moisture damage. For example, water which seeps underneath vinyl or tile floor coverings can cause damage which is not immediately detectable. Such seeped moisture may be wicked along beneath the floor covering for a substantial distance from the affected appliance. In addition, moisture which penetrates beneath any surface covering may cause damage to a wooden sub-floor and supporting joists as well as to adjacent to ceiling surfaces below.

While previous moisture leak detection systems are well-suited for detecting a continuous substantial leak, they are not capable of detecting slow or intermittent leakage of a very small quantity of moisture, such as one or two drops to a concealed space such as the floor surface beneath an appliance. Previous systems also require permanent placement of sensors beneath flooring surfaces, which is both expensive and inflexible. Such systems provide relatively small sensing areas, leaving other areas in the vicinity unprotected.

Consequently, there is a need for a small, relatively inexpensive device that can be placed under or behind appliances and fixtures to provide a relatively large moisture sensing area as soon as a leak begins and alert the homeowner, thus allowing the leak to be fixed before any water damage has occurred to the floor covering. This device would allow the homeowner to fix a leak while it was still small and thereby avoid the possibility of the leak suddenly getting much larger and causing extensive damage, as, for example, by flooding a room.

SUMMARY OF INVENTION

The present invention provides a leakage response system for an appliance including a sensor strip or mat which can be installed unobtrusively in areas prone to moisture leakage for prompt detection of minute quantities of moisture and a controller unit for actuation of a remote alarm and/or a water supply line shut-off valve before damage can occur to a floor covering.

In more detail, the system includes a leakage sensor strip which is operative to change an electrical parameter upon contact by a conductive liquid, a controller circuit electrically coupled with the strip for generating an activation signal in response to contact of the strip by a conductive liquid and a response device coupled with the controller circuit and activated by the signal. The sensor strip is constructed of top and bottom outer layers of electrically conductive fabric separated by a central nonconductive fabric layer; and a pair of fusing layers fusing the top and bottom layers to the central nonconductive layer. The response device may include an audible alarm and/or a valve for shutting off the water flow in the appliance water supply line. The response device may also include a radio transmitter for activating a remote alarm and shut off valve.

DETAILED DESCRIPTION

Figure 1:
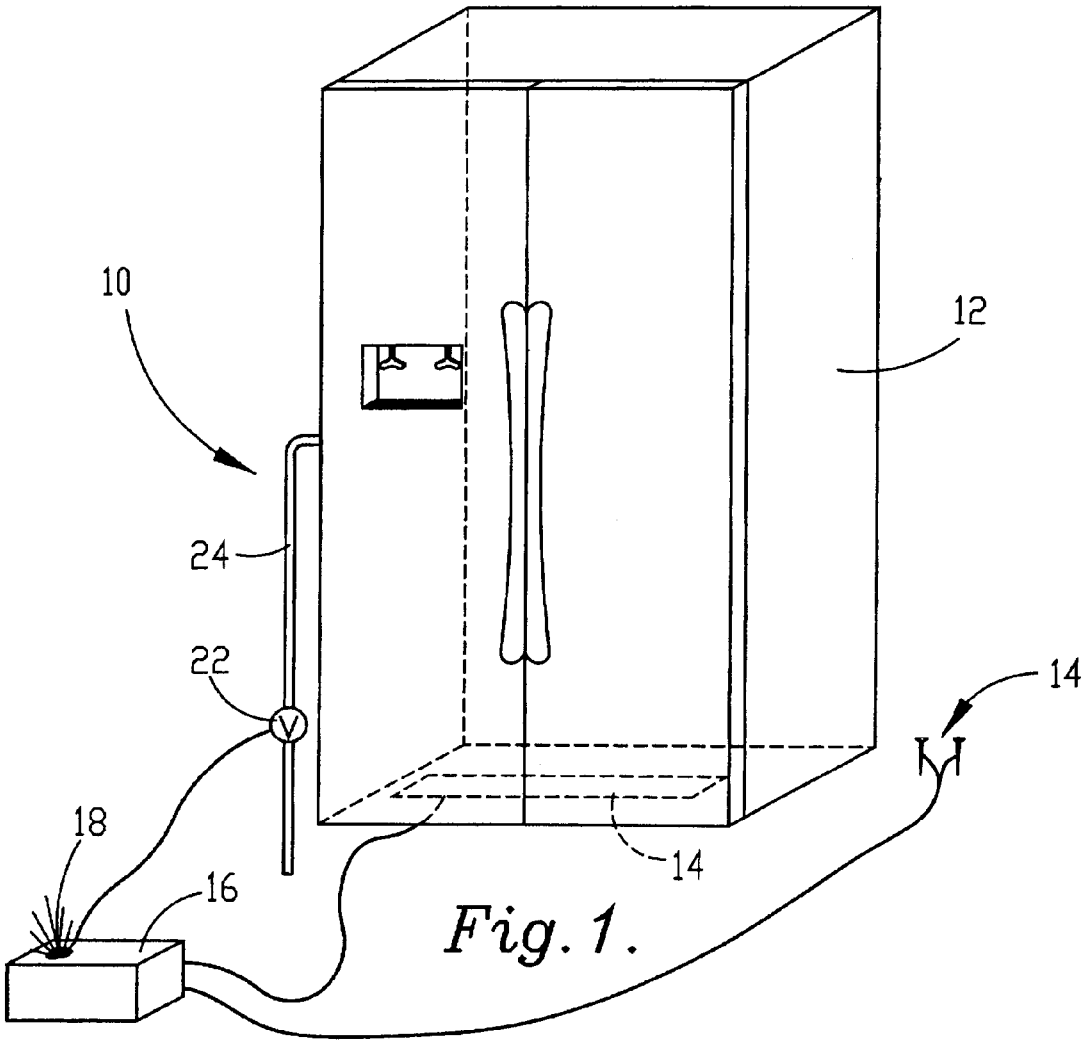
FIG. 1 is a diagrammatic perspective view of a leakage response system in accordance with the present invention, illustrated as installed to respond to leakage from a refrigerator.

Referring now to the drawings, the reference numeral 10 refers to a leakage response system in accordance with the present invention, which senses moisture from a leak and responds to such a leak by an alarm and/or an action to stop the leak.

The system 10 is shown installed beneath an appliance 12, and generally including a sensor assembly 14, controller assembly 16, radio frequency or RF link 18, alarm or sounding device 20 and valve assembly 22, shown installed on a water supply line 24.

Figure 4:
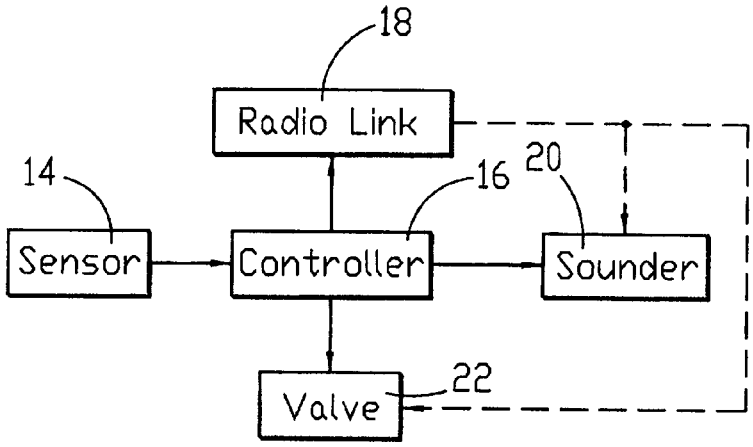
FIG. 4 is a block diagram of the leakage response system in accordance with the present invention.
Figure 2:
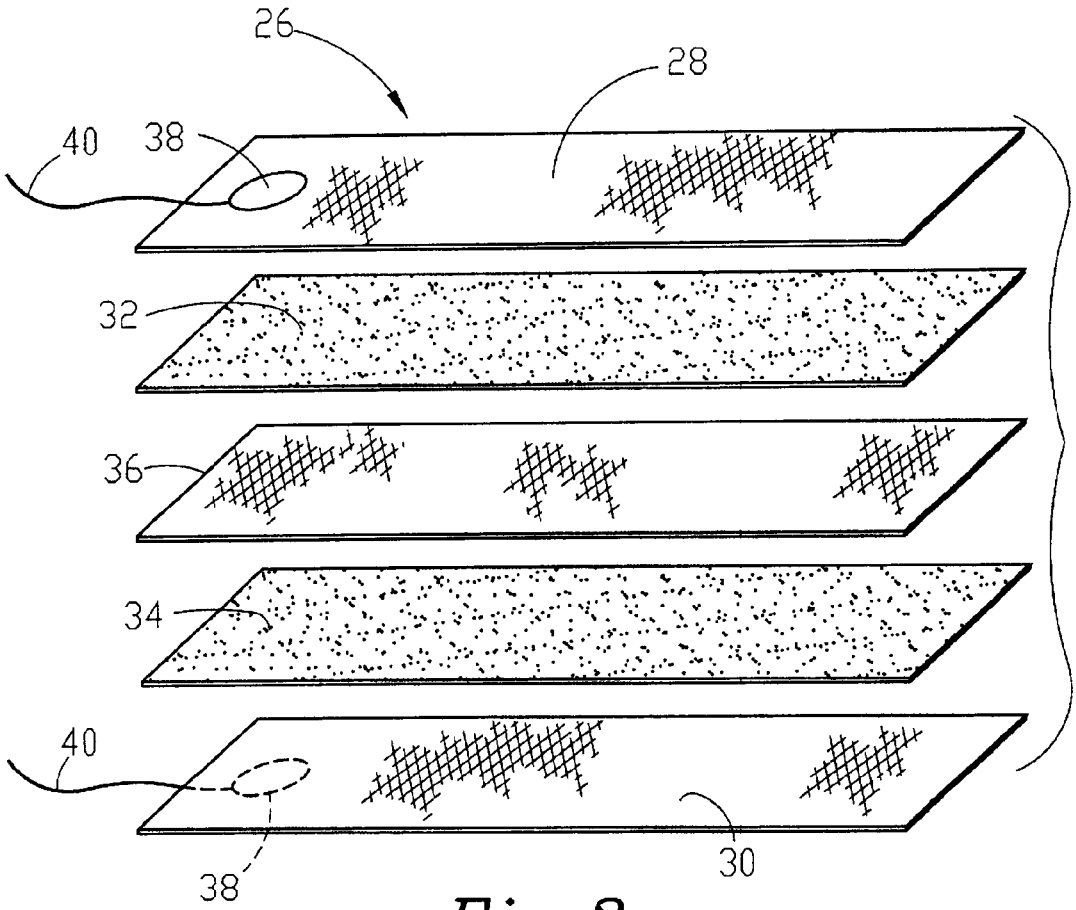
FIG. 2 is an enlarged, exploded diagrammatic perspective view of the layers of a sensor mat.
Figure 3:
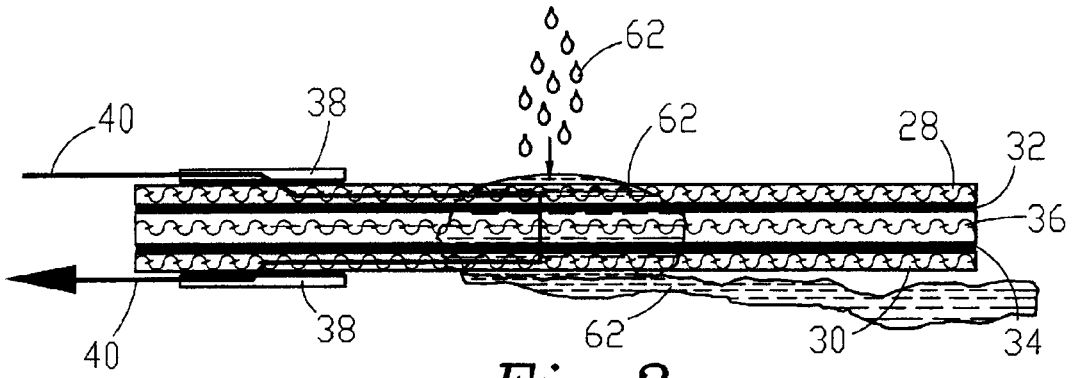
FIG. 3 is an enlarged diagrammatic sectional view of the sensor mat of FIG. 2 showing an electrical circuit closed by a conductive fluid.

As best shown in FIGS. 2–4, the sensor assembly 14 includes a strip or mat 26 of multilayered, generally planar construction, having respective top and bottom outer conductive layers 28 and 30, top and bottom inner fusing layers 32 and 34, and a central nonconductive layer 36. The outer layers 28 and 30 are formed of an absorbent, conductive fabric, such as a polyacrylic composition impregnated with carbon black. A material which is particularly well suited for use as the layers 28 and 30 is sold under the trademark VILEDON® by the Freudenberg Corporation. Other suitable fabrics incorporate copper, nickel and mixtures thereof as conductive elements. One such suitable fabric is sold under the trademark Seiren™ by the Seiren Co., Ltd. Other conductive elements which may be incorporated in a fabric strip and are also known to be suitable for use in the present invention include titanium, chrome, vanadium, iron, zinc, aluminum, silver, tin, tungsten, platinum, gold, mercury and carbon. Those skilled in the art will appreciate that any other electrically conductive material may be employed to form the conductive layers 28 and 30, including non-metallic and polymeric conductive materials.

Either woven or nonwoven fabric may be employed, and it may be formed of any porous, absorbent material which is of natural origin, such as cotton, silk, rayon, ramie or any synthetic fabric such as nylon and polyacrilamide or of a mixture thereof. It is also foreseen that paper products such as paper and cardboard may be employed. The conductive elements may be incorporated within the threads of a fabric layer or the substance of a paper layer, they may be deposited on fabric threads as a coating, or they may be deposited on a fabric or paper layer as a coating. A dust of a conductive element, such as for example, copper dust, may be fused with paper. A fabric or paper nonconductive layer or may be imprinted with a conductive ink, or paint or coated with a conductive glue. Alternatively, a net of conductive element or a substance electroplated with a conductive element may be incorporated into the fabric or paper layer. The preferred fabric or paper layer offers a resistance of from about 0 Ohms per square inch to about 10,000 Ohms per square inch. The top and bottom fusing inner layers 32 and 34 are generally formed of a porous, heat activated glue, especially as sold under the trademark VILENE® by Freudenberg, Inc. Any hot or cold setting adhesive product may also be employed to bond the conductive outer layers 28 and 30 to the central nonconductive layer 36. The adhesive may be in sheet form, or it may be in liquid, aerosol, granular or powder, or any other suitable form.

The central nonconductive layer 36 may be formed of any suitable porous, nonconductive material. In particularly preferred forms, materials having limited absorption properties are preferred, such as, for example, polyester, nylon, or polyvinylchloride mesh.

The outermost surfaces of the top and bottom outer layers 28 and 30 each include a connection or terminal pad 38 for coupling an electrical conductor 40 with the layers 28 and 30. The opposed ends of the conductors 40 are coupled with a controller 16 as hereinafter described.

While a sensor strip or mat 26 is depicted having a generally rectangular configuration, any suitable shape may be employed and the shape of the mat 26 may be customized in accordance with the footprint of the appliance 12.

Figure 6:
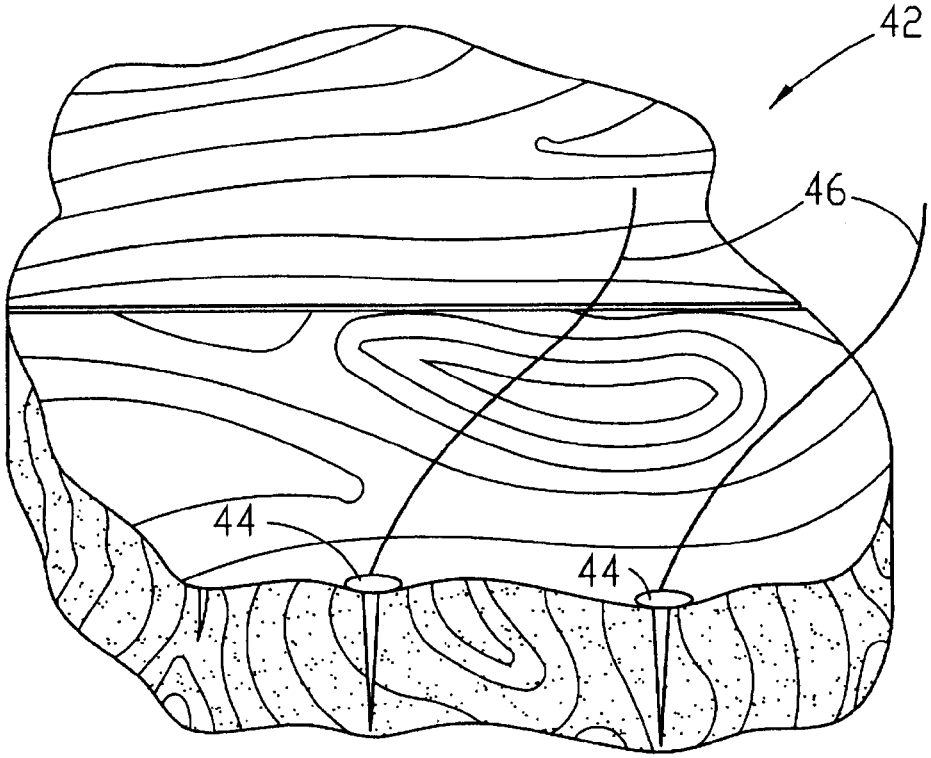
FIG. 6 is an enlarged side perspective view of a pair of sensor pins.

As best shown in FIG. 6, the sensor assembly 14 also includes a probe assembly 42 having a pair of pins or probes 44 for installation into a flooring, wall or ceiling surface for detecting moisture hidden below the visible surface, such as, for example, below the visible surface of a hardwood floor. The upper portion of each pin 44 is each coupled with an electrical conductor 46, which in turn is coupled with the controller assembly 16. The pins 44 are constructed of a conductive material, preferably a metal and are installed into a flooring surface in proximate, spaced relationship.

Figure 5:
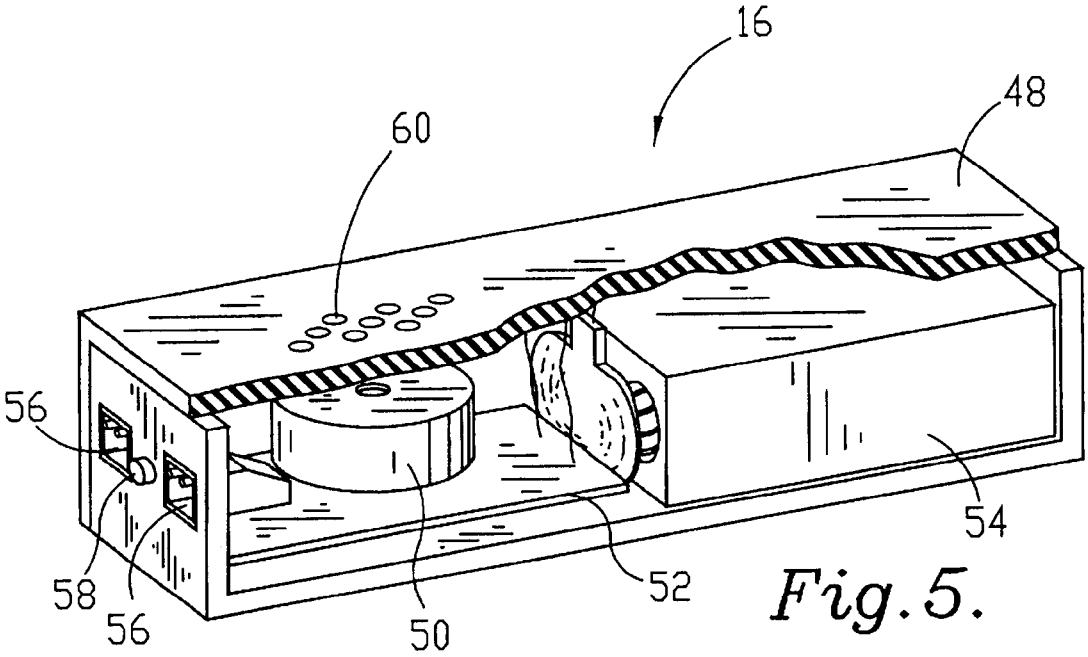
FIG. 5 is an enlarged perspective view of a controller assembly with parts of the housing broken away.

As best shown in FIG. 5, the controller assembly 16 includes a housing 48, having a controller 50 mounted on a printed circuit board 52, a power supply 54, and an alarm unit 20. A radio transmitter (not shown) may also be included. The housing 48 is constructed of a light weight, synthetic resin material, although it could also be constructed of metal or any other suitable material. The housing 48 is constructed to be as small as is practicable to facilitate placement under or behind an appliance 12. In one embodiment, the housing 48 has a length of about 4 inches and a width of about 1.5 inches and a depth of about 1 inch.

While a the power supply 54 is depicted in the form of a 9 volt battery, any suitable battery such as AA, AAA or smaller, "button" type batteries may be employed depending on the requirements of the actual circuitry employed. It is foreseen that the controller assembly 16 may also derive operating power from a conventional wall socket (not shown), as by use of a plug-in type of transformer (not shown). A pair of plug connections 56 are provided for coupling the unit 16 with the probe assembly 42 or, alternatively, with an additional sensor mat 26. A test button 58, which is accessible from the outside of the housing 48 may also be provided.

The controller 50 functions to cause a response action in response to a change in the electrical parameter sensed by the sensor mat 26. The controller 50 may function in such a manner that when an input signal reaches a certain level, it activates an output signal, by use of a Schmitt trigger or the like. Alternatively, the controller may incorporate a microprocessor or microcontroller, such as one of the "PIC", Microchip Technology, Inc. or other embedded single chip type processor, or of any other suitable design. In such embodiments, the controller 50 is factory programmed to execute the following functions: detecting a change of resistance of the sensor mat 26, activating an output signal in response to a selected level of resistance change of the sensor 26, supporting a test button 58, processing of a low battery voltage signal, generation of a low battery alarm for actuating the audio alarm unit 20. If a radio link 18 is employed, it is preferable that a coded activation signal be used to avoid false activation of the alarm 20 or valve 22 by a spurious signal. A microprocessor type controller 50 may also be programmed to execute any of a number of other functions as well, such as measuring the quantity of the sensed moisture and differentially actuating one or more alarm units 20 and/or valves 22 in accordance with a preprogrammed response.

An optional radio link 18 may be employed to relay response signals to the alarm device 20 or valve 22. The radio link 18 includes a transmitter and receiving set (not detailed), which operate on an FCC approved radio frequency and may also comprise a radio data type set employing a digitally encoded signal.

The alarm unit 20 may be mounted within the controller assembly housing 50. In such embodiments, the housing 50 is equipped with a series of apertures 60 to facilitate emission of an audible signal. Alternatively, the alarm 20 may be positioned in a remote location and may be actuated via the radio link 18. A piezo buzzer or any other suitable audible alarm device may be employed. The controller 50 may actuate the alarm 20 intermittently in order to conserve a battery power supply 54. Sounding the alarm for periods of about 4 seconds interspersed by periods of silence of about 8 seconds permits a piezo buzzer type alarm to sound for approximately 4 to 5 months before exhausting a 9 volt battery.

The valve assembly 22 is preferably a solenoid controlled, magnetic latching or servo or motorized shut off valve capable of actuation at a very low amperage. The valve is mounted in a water supply line 24 to an appliance 12, where it can be actuated to close off a leaking portion of the line, thus preventing continued moisture leakage.

In use, a sensor mat 26 may be cut to a predetermined size and shape using a household scissors (not shown) without any impairment to its conductivity. The mat 26 is installed by placing it adjacent or in a concealed location beneath an appliance 12. The probe assembly 42 is installed by pushing the pins 44 into a flooring surface in a location where moisture is most likely to travel beneath the surface in the event of a leak. Multiple sensor strips 26 and/or probe assemblies 42 may be installed under various appliances in a household or apartment building and linked to each other or to a central controller assembly 16 via a radio link 18. It is also foreseen that the entire system 10 may be installed between the walls of a building or that a sensor strip 26 and/or probe assembly 42 may be installed in a ceiling for detecting moisture leakage from an appliance located on the floor above.

Each sensor strip 26 and probe assembly 42 is coupled with a radio link 18, which actuates a controller assembly 16 containing either a power supply 54 or a plug connection to household wiring (not shown). The control assembly 16 is coupled with an alarm unit 20, and may also be operatively coupled with a valve assembly 22. Alternatively, the radio link 18 may generate a signal which actuates an alarm unit 20 and/or valve assembly 22. As best shown in FIGS. 1, 3 and 4, a slow leak in the concealed space beneath the appliance 12 delivers drops of a conductive fluid 62, such as water, which is wicked through the mat 26, conductively bridging between the sensor strip top outer layer 28 and the bottom outer layer 30 through the center layer 36 and closing a circuit. Alternatively, drops of a conductive fluid 62 hidden beneath a flooring surface, such as, for example hardwood, conductively bridge the gap between the pins 44 of a the probe assembly 42, closing a circuit.

The sensor mat 26 or probe assembly 42, thus actuates the controller assembly 16 which activates the alarm unit 20. The controller assembly 16 may also actuate the valve 22 in the water supply line 24 to a closed position in which it ceases to supply water to the appliance 12. The controller may activate the sounder 20 or valve 22 by way of the radio link 18. It is foreseen that the controller assembly 16 may also be hard wired to the alarm unit 20 and/or valve 22. Where multiple sensor mats 26 are installed under various appliances 12 in a household or apartment building, each is responded to by the controller assembly 16 to output a signal to a central alarm unit 20 or a respective valve 22. An additional controller assembly 16 may also serve as a master or central controller 16 for transmitting a signal to a station via a proprietary household alarm system. Multiple sensor mats 26 and/or probe assemblies 42 may be coupled with one or more controllers 16, radio links 18 or alarms 20 or supply line valves 22.

Figure 7:
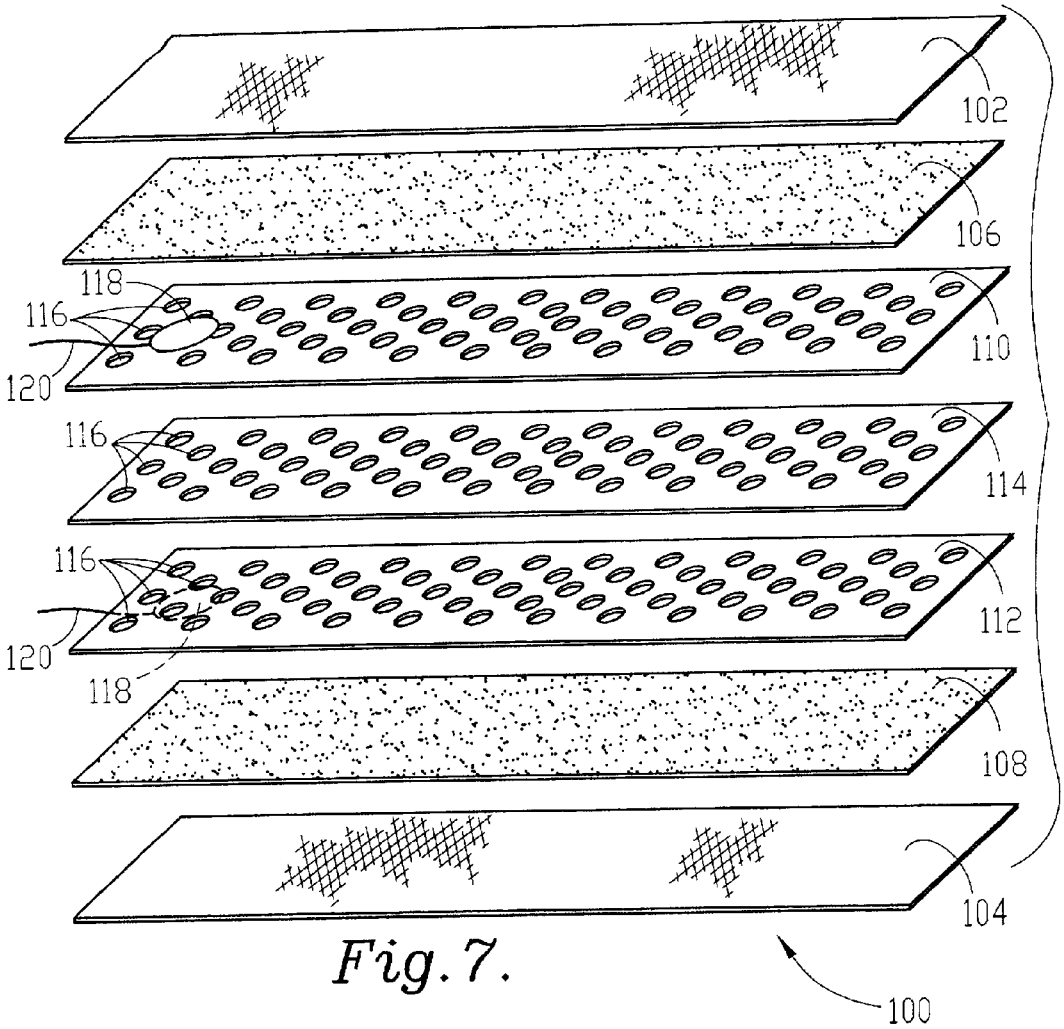
FIG. 7 is an enlarged, exploded diagrammatic perspective view of the layers of an alternate sensor strip.

As best shown in FIG. 7, a second embodiment of a sensor mat 100 for use in conjunction with the leakage response system 10 is illustrated. The sensor mat 100 is of multilayered, generally planar construction, having top and bottom absorbent layers 102 and 104, top and bottom inner fusing layers 106 and 108, top and bottom conductive layers 110 and 112, and a central nonconductive, insulating layer 114.

The outer, absorbent layers 102 and 104 are formed of a thin material which absorbs water easily, such as a natural material like cotton, silk, rayon or ramie or any synthetic fabric such as nylon, polyacrilamide or a mixture thereof. While either woven or non-woven material may be employed, a non-woven material having superior wicking properties is preferred. The top and bottom inner fusing layers 106 and 108 may be formed of any heat activated or cold setting adhesive substance. The adhesive may be in sheet form, for example as sold under the trademark VILENE® by Freudenberg, Inc., or it may be applied in any other suitable form.

The Top and bottom conductive layers 110 and 112 are formed of a conductive foil such as aluminum or copper, although any suitable conductive substance, as previously described herein, may be employed. The central nonconductive layer 114 may be formed of any suitable nonconductive material, such as paper or synthetic resin. A natural or synthetic fiber material may also be employed.

The top and bottom conductive layers 110 and 112 and the central insulating layer 114 each include an identical pattern of spaced apertures 116. The apertures are about 7 mm in diameter and are spaced apart about 25 mm, although any other configuration which provides sensitivity to one or two drops of moisture may be employed. The conductive and insulating layers 110, 112 and 114 are coupled together by electrolamination with the apertures aligned.

The outermost surfaces of the top and bottom conductive layers 110 and 112 each include a connection pad 118 for coupling with an electrical conductor 120. The opposed ends of the conductors 120 are coupled with a controller assembly (not shown) as previously described.

Figure 8:
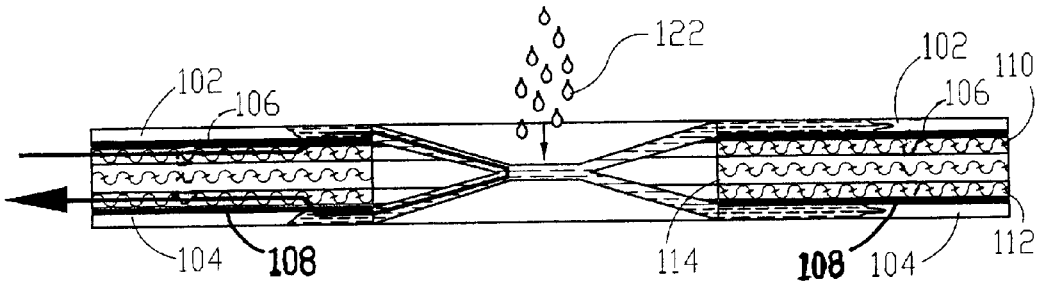
FIG. 8 is an enlarged diagrammatic sectional view of the sensor mat of FIG. 7 showing an electrical circuit closed by a conductive fluid.

In use, a sensor mat 100 is installed as previously described. As best shown in FIG. 8, a drop of moisture 122 encounters the mat 100, for example, from above and is wicked along the top absorbent layer 102. When the moisture 122 reaches an aperture 116, it is wicked through to the bottom absorbent layer 104, closing a circuit.

While the leakage response systems 10 has been described in association with monitoring moisture leakage from household appliances, 12, sensor mats 26, 100 and probe assemblies 42 could also be placed in a home basement to alert the resident. Similarly, they could be employed in a commercial environment such as an office building or apartment complex.

Having described the preferred embodiments of the present invention, the following is claimed as new and desired to be secured by Letters Patent:

1. A leakage response apparatus for responding to leakage of a conductive liquid from an appliance and including:

a leakage sensor unit operative to change an electrical parameter thereof upon contact by a conductive liquid;

a controller circuit electrically coupled to said sensor unit and operative to generate an activation signal in response to said contact of said sensor unit by a conductive liquid;

a response device coupled to said controller circuit and activated by said activation signal; and said sensor unit being formed of:

first and second electrically conductive outer layers having a porosity allowing for passage of the conductive liquid therethrough;

a central nonconductive layer having a porosity allowing for passage of the conductive liquid therethrough; and a pair of fusing layers fusing said first and second layers to said central nonconductive layer, said fusing, layers having a porosity allowing for passage of the conductive liquid therethrough, said liquid bridging said conductive outer layers and fusing layers allowing said controller circuit to generate said activation signal.

2. The apparatus according to claim 1, wherein:

said fusing layers are heat activated to fuse said first and second layers to said central layer.

3. The apparatus according to claim 1, wherein:

said first and second conductive layers include carbon black.

4. The apparatus according to claim 1, wherein:

said central nonconductive layer is porous.

5. The apparatus according to claim 1, wherein:

said first and second layers and said central nonconductive layer are formed of a fabric.

6. The apparatus according to claim 1, wherein:

said responsive device includes an audible alarm.

7. The apparatus according to claim 1, wherein:

a water supply line is coupled with an appliance for delivering a supply of water; and said response device includes a solenoid controlled valve operably coupled with said water supply line, said valve shiftable between an open position permitting a flow of water through the supply line and a closed, water flow blocking position.

8. The apparatus according to claim 1, further including:

a battery power supply providing operating power to said controller circuit.

9. The apparatus according to claim 1, further including:

a radio link functionally coupled between said controller circuit and said response device.

10. A leakage response apparatus for responding to leakage of a conductive liquid from an appliance and including:

a leakage sensor unit operative to change an electrical parameter thereof upon contact by a conductive liquid;

a controller circuit electrically coupled to said sensor unit and operative to generate an activation signal in response to said contact of said sensor unit by a conductive liquid;

a response device coupled to said controller circuit and activated by said activation signal; and said sensor being formed of:

first and second moisture absorbent outer layers having a porosity allowing for passage of the conductive liquid therethrough;

first and second conductive layers having a porosity allowing for passage of the conductive liquid therethrough;

a central nonconductive layer having a porosity allowing for passage of the conductive liquid therethrough; and a pair of fusing layers fusing said first and second moisture absorbent outer layers to said respective first and second conductive layers, said fusing layers having a porosity allowing for passage of the conductive liquid therethrough, said liquid bridging said conductive layers allowing said controller circuit to generate said activation signal.

11. The apparatus according to claim wherein:

said first and second conductive layers include a conductive metallic foil;

said conductive metallic foil includes a series of spaced apertures; and said fusing layers fuse said first absorbent outer layer to said second absorbent outer layer in covering relationship to said apertures.

12. The apparatus according to claim 10, wherein:

said response device includes an audible alarm.

13. The apparatus according to claim 10 wherein:

a water supply line is coupled with an appliance for delivering a supply of water; and said response device includes a solenoid controlled valve operably coupled with said water supply line, said valve shiftable between an open position permitting a flow of water through the supply line and a closed, water flow blocking position.

14. The apparatus according to claim 10, further including:

a radio link functionally coupled between said controller circuit and said responsive device.

* * * * *

UNITED STATES PATENT AND TRADEMARK OFFICE

CERTIFICATE OF CORRECTION

PATENT NO. : 6,731,215 B2
DATED : May 4, 2004
INVENTOR(S) : Frederick H. Harms and Charles McKenzie It is certified that error appears in the above-identified patent and that said Letters Patent is hereby corrected as shown below:

Column 8,
Line 24, after "claim" insert -- 10 --.

Signed and Sealed this

Third Day of August, 2004

JON W. DUDAS
*Acting Director of the United States Patent and Trademark Office*